United States Patent [19]

Twichell

[11] 4,077,284

[45] Mar. 7, 1978

[54] STONE SETTING PRESS

[75] Inventor: Paul M. Twichell, Brewster, Mass.

[73] Assignee: Guertin Brothers, Inc., Hyannis, Mass.

[21] Appl. No.: 626,738

[22] Filed: Oct. 29, 1975

[51] Int. Cl.[2] ..... B23P 5/00

[52] U.S. Cl. ..... 81/7; 29/251; 29/10; 72/452

[58] Field of Search ..... 29/251, 267, 10, 243.5, 29/243.53, 243.56; 81/7; 72/452

[56] References Cited

U.S. PATENT DOCUMENTS

| | | | |
|---|---|---|---|
| 2,184,356 | 12/1939 | Lindgren | 29/251 |
| 2,341,037 | 2/1944 | Halper | 29/267 |
| 2,629,442 | 2/1953 | Veilleux | 29/251 |
| 3,766,809 | 10/1973 | Schneider | 81/7 |

FOREIGN PATENT DOCUMENTS

| | | | |
|---|---|---|---|
| 232,166 | 8/1944 | Switzerland | 81/7 |

*Primary Examiner*—James L. Jones, Jr.
*Assistant Examiner*—Roscoe V. Parker
*Attorney, Agent, or Firm*—Wolf, Greenfield & Sacks

[57] ABSTRACT

A stone setting press for securely fastening stones to settings comprising an arbor supported on a frame or base, shaped to receive and support a ring setting. A forming die at the end of a shaft is shaped to deform the prongs of a setting about a stone. The shaft is supported on the frame for axial movement to and from a position in which the die shapes the prongs. A leverage system having variable mechanical advantage is used to actuate the shaft.

8 Claims, 3 Drawing Figures

STONE SETTING PRESS

INTRODUCTION AND BACKGROUND

In the retail jewelry business it is desirable to be able to securely and effectively set a variety of combinations of stones and settings. For example, customers may want special combinations of birthstones in selected ring settings thus, it is most advantageous to the dealer to be able to set these stones when requested by the customer and while he waits.

The present invention relates to a manually operable tool for the setting of stones in stone settings, and more particularly it comprises a frame in which a vertically oriented die tipped shaft can be axially displaced by a cam mechanism which, being turned by a handle, provides a maximum mechanical advantage when the shaft is in its most downward position. A stone setting supporting cylindrical arbor is so located and interconnected with the frame that when the specially shaped die tip of the shaft is in its lowest position it engages and crimps the prongs of the setting around the stone.

A tool constructed according to this invention is especially convenient for setting stones in rings, the settings for which fit simply over the arbor. Other devices, not having this feature have much more complicated clamping or other means for retaining settings. Further, a tool constructed according to this invention provides a maximum mechanical advantage and, therefore, a maximum of force applied to bend the prongs of setting just as the tip reaches its maximum downward displacement. This feature makes a tool constructed according to this invention very stable in operation since the operator has to apply very little force to secure the stone to the setting and is therefore highly unlikely to upset the tool, while in operation. Other stone setting tools requiring larger external forces for their operation are unstable unless securely clamped, whereas an embodiment of the present invention, never requiring more than slight external pressure, need not be fastened down, and as a result, is more portable.

Another consequence of the cam operated shaft is that no force can be applied to it to move the tip past a pre-set downward most engaging position so that neither stones nor settings can be destroyed by careless operation. Known stone setting devices have used complicated spring loaded stone setting supports to reduce the likelihood of damage. The present device however, eliminates this problem.

One object of this invention is to provide an easily operated stone setting press of inexpensive design.

Another object of this invention is to provide a highly portable stone setting press which, because little force need be externally applied to it, does not have to be clamped down, or have a heavy base, for stable operation.

Still another object of this invention is to provide a stone setting press in which the prong bending means cannot be forced past a limiting point and which therefore cannot shatter the stone being set.

A further object of this invention is to provide a stone setting press which is especially adapted to handle ring settings and requires no clamping means for such settings.

Still another object of this invention is to provide a stone setting press which completely and accurately crimps the prongs of a setting by providing the application to the prongs of maximum force as they approach their optimal positions around the stone.

These and other objects and features of this invention may be better understood by consideration of the following description of one embodiment thereof.

BRIEF FIGURE DESCRIPTION

DETAILED DESCRIPTION

Figure 1:
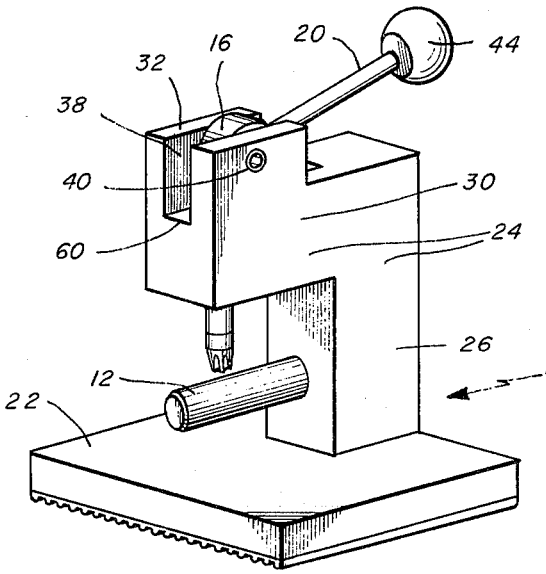
FIG. 1 is a perspective view of a stone setting press constructed according to this invention.
Figure 2:
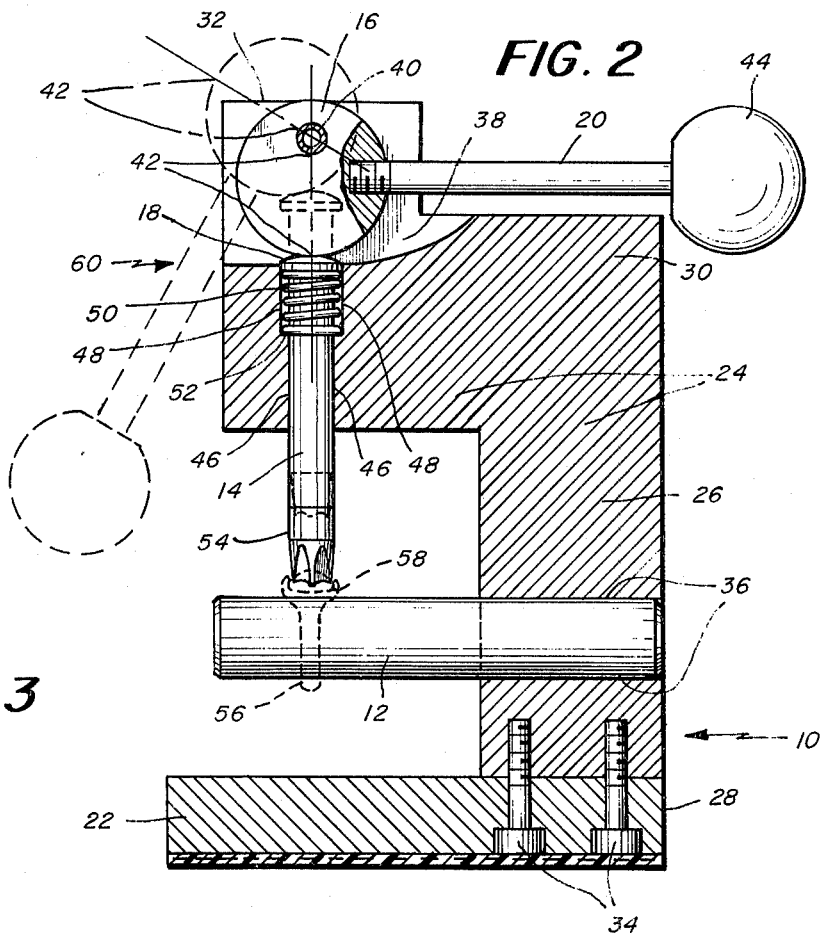
FIG. 2 is a central vertical cross-sectional view of the stone setting press taken in a medial plane containing the handle and the arbor, showing the shaft in its downward most position. The cam, handle and shaft are also shown in dotted outline with the shaft in its upward most position.
Figure 3:
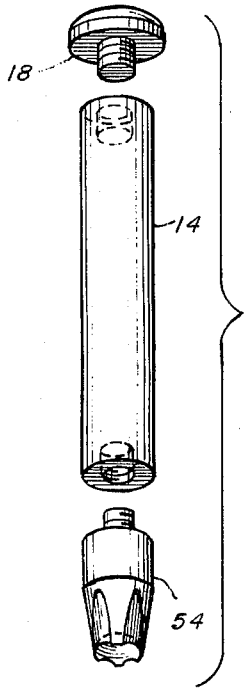
FIG. 3 shows the details of the shaft with its die tip and head.

The specific embodiment of this invention, relating to stone setting presses, shown in FIGS. 1–3 comprises generally a common frame 10, an arbor 12 horizontally positioned and extending from the frame, a shaft 14 vertically slidable in the frame above the free end of the arbor, a cam 16 located so that it is in contact with the head 18 of the shaft, and a handle 20 for turning the cam.

More specifically, the frame consists of a base 22, which is to be positioned on a horizontal surface, and an upright 24. This upright has and comprises a right angle member having legs 26 and 30.

The outer end of leg 26 is secured to one edge of the base with the second leg 30 of the upright member extending parallel to and over the upper surface of base 22.

A rectangularly shaped block or protrusion 32 is secured to the outer end of leg 30. The base 22 may be rigidly connected to the upright 24 with a counter sunk lap screw 34 which is recieved in the bottom of the leg 26 of the upright 24.

The cylindrical arbor 12 is rigidly retained in the upright 24, fitting tightly into the cylindrical hole 36 horizontally machined in the leg 26. The arbor 12 is coextensive with and centered below leg 30.

A vertical slot 38 extends longitudinally through the center of the block 32 and extends downwardly into the leg 30 as is shown best in FIG. 2. Located within the slot 38 is the cylindrically shaped cam 16 which is eccentrically and rotatably mounted on an axle like supporting means 40 which is non-slidably retained in a horizontally transverse attitude in holes in the sides of the block 32.

A handle 20 is rigidly seated in the cam 16 so that it extends therefrom along a line perpendicular to the maximum radial projection 42 of the cam. When the projection 42 is oriented vertically the handle 20 extends horizontally back just above the upper surface of the leg 30. The handle is long enough so that the knob 44, at its distal end, just clears the leg 20 of the upright.

The shaft 14 slidably runs through the shaft receiving hole 46 that extends through the leg 30 in such a way that its axis and, therefore, the axis line of the shaft run vertically in the medial plane of leg 30 from the cam axle 40 down to make an intersection with the axis of the arbor 12.

The hole 46 has an upper section 48 with a larger diameter than the lower section forming a shoulder 52 intermediate the ends of the hole 46. The diameter of the lower section is sized to provide a sliding fit for the shaft 14. A spring 50 coiled about the shaft engages the shoulder 52 at one end and the lower surface of the head 18 at the other end. The spring 50 normally biases the shaft upwardly against cam 46. The shaft 14 is limited in its axial movement by the shoulder 52 in a downward direction and interengagement of the head 18 and cam 16 in an upward direction.

The shaft 14 is free to rotate on its axis to accommodate or adjust to minor variances in the prong locations on a setting when the die is brought into contact with the setting.

As is best seen in FIG. 3 the case hardened die 54 of the shaft 14 is specially shaped to engage and deform the prongs of the stone setting 56 around the stone 58. The length of the shaft 14 is so chosen that, when the cam 16 is oriented with its maximum radial projection in contact with the head 18 of the shaft 14, the latter, being in its downward most position maintains its die 54 in the prong engaging position as shown in FIG. 2. When the cam is oriented in any other way the spring 50 biases the shaft 14 upward so that the tip 54 is never located below the engaging position above the arbor 12.

The stone setting press depicted in FIGS. 1–3, which is just one embodiment of this invention, is operated as follows:

The handle 20 is brought to a position as shown in dotted outline 2 in FIG. 2 in the front of the leg 30 and is supported there by the forward edge of the bottom surface 60 of the slot 38. In this configuration the cam 16 has a relatively small downward facing radial projection and, as a consequence, the shaft 14 is upwardly biased away from the arbor 12.

A finger ring having a stone setting is positioned on the arbor 12, directly below the shaft 14, with its prongs facing upward. A stone is placed in the setting between the prongs.

The handle is then brought up and over the shaft bringing ever larger radial projections of the cam 16 into contact with the head 18 of the shaft 30 moving it down until the tip 54 first comes in contact with the prongs of the setting 56. As the handle 20 is further rotated toward the upper surface of the overhang 30, the tip is moved down, continuing to deform the prongs until, the deformation of the prongs is complete, when the maximum radial projection 42 of the cam 16 is vertically oriented. Should the handle 20 be turned past the position shown in FIG. 2 in which the cam 16 brings the tip into the engaging position, the tip begins ascending rather than going down further and shattering the stone.

After the prong crimping operation is completed the handle 20 is returned to the position shown in dotted outline in FIG. 2 so that the setting, now securely set with stone, can be removed.

One of the important advantages of this device resides in the fact that the cam and lever operation provides a variable mechanical advantage which attains a maximum value at the tip approaches the engaging position. This means that very little force need be applied to the handle to finally deform the prongs of the setting and, since this tool is not being subject to large torques it is very stable in operation.

What is claimed is:

1. A stone setting press for securing a stone to a stone setting comprising:

a common frame, a shaft having a head at one end and a die at the other end shaped to engage and deform the prongs of a setting about a stone when said die is moved to a prong deforming position, said shaft being longitudinally rigid from its head to its die, means journaling said shaft in said frame for axial movement to and from said deforming position, a leverage system supported on said frame and positioned to engage the head of said shaft to apply axial forces to said shaft for movement thereof to bring said die to said deforming position, said leverage system including a cam rotatably supported by said frame for rotation about an axis normal to the longitudinal axis of said shaft and further including means to rotate said cam, said cam having a cam surface defined in part by a maximum radial projection having a length such that rotation of the cam moves said shaft to said deforming position when said cam surface engages said head at said maximum radial projection;

said leverage system being constructed and arranged to urge the shaft toward said deforming position under a progressively increasing mechanical advantage and under a progressively increasing force as said die approaches said deforming position, said force reaching its maximum just as said die approaches said deforming position, a setting support for retaining a stone setting at said deforming position, and said setting support comprising, an arbor extending along an axis normal to the axis of said shaft with a portion of its surface located along the axis line defined by said shaft, and at a distance from said shaft beyond said deforming position, and means securing said arbor to said common frame.

2. A press as set forth in claim 1 further characterized by means yieldably biasing said shaft along its longitudinal axis toward said cam to maintain, at all times, the head of said shaft in contact with the surface of said cam.

3. A press as set forth in claim 1, further characterized by said arbor being cylindrically shaped for receiving a ring stone setting.

4. A press as set forth in claim 3 further characterized by said frame having a base for placement on a flat horizontal surface, said longitudinal axis of said shaft being vertical and said die being at the lower end of said shaft.

5. A press as set forth in claim 2 wherein said biasing means comprises a spring disposed about said shaft, the lower end of said spring being engaged by a shoulder formed in the frame, said head of said shaft being of enlarged diameter to engage the upper end of the spring, said spring being selected to remain in compression between the shoulder and the head in all rotational positions of the cam, said tip of said shaft being case hardened steel.

6. A press as set forth in claim 1 further comprising:

a handle attached to and extending from the cam, said handle extending along a direction which is substantially normal to the direction of said maximum radial projection.

7. A press as defined in claim 2 further comprising said cam being constructed and arranged so that continued rotation of the cam beyond said position in which the maximum radial projection is in contact with the head will cause the shaft to be retracted from said engaging position.

8. A press as set forth in claim 1 further characterized by said cam being circular and being supported on the frame by a transversely extending pin which is eccentrically disposed with respect to the circular cam.

* * * * *